US009145000B2

(12) United States Patent
Lakin et al.

(10) Patent No.: US 9,145,000 B2
(45) Date of Patent: Sep. 29, 2015

(54) PRINTING APPARATUS AND METHOD OF OPERATING A PRINTING APPARATUS

(71) Applicant: Markem-Imaje Industries Limited, Nottingham (GB)

(72) Inventors: Phillip Lakin, Nottingham (GB); Simon Starkey, Leicester (GB); Paul Christopher Roberts, Cambridge (GB); Jonathan Michael Gloag, Cambridgeshire (GB)

(73) Assignee: Dover Europe Sàrl, Vernier (CH)

( * ) Notice: Subject to any disclaimer, the term of this patent is extended or adjusted under 35 U.S.C. 154(b) by 0 days.

(21) Appl. No.: 14/179,832

(22) Filed: Feb. 13, 2014

(65) Prior Publication Data

US 2014/0225971 A1 Aug. 14, 2014

(30) Foreign Application Priority Data

Feb. 13, 2013 (GB) ..... 1302542.4

(51) Int. Cl.
*B41J 33/14* (2006.01)
*B41J 2/325* (2006.01)
*B41J 33/34* (2006.01)

(52) U.S. Cl.
CPC *B41J 2/325* (2013.01); *B41J 33/14* (2013.01); *B41J 33/34* (2013.01)

(58) Field of Classification Search
USPC ..... 347/215, 217; 400/225, 232, 234
See application file for complete search history.

(56) References Cited

U.S. PATENT DOCUMENTS

| | | | |
|---|---|---|---|
| 4,924,240 | A | 5/1990 | Herbert |
| 5,254,924 | A | 10/1993 | Ogasawara |
| 5,325,115 | A | 6/1994 | Tanahashi |
| 5,614,803 | A | 3/1997 | Morioka |
| 5,751,331 | A | 5/1998 | Higuchi |
| 5,908,251 | A | 6/1999 | Buckby |
| 5,921,689 | A | 7/1999 | Buckby |
| 5,975,777 | A | 11/1999 | Nelson |
| 6,068,206 | A | 5/2000 | Lindsay |

(Continued)

FOREIGN PATENT DOCUMENTS

| | | | |
|---|---|---|---|
| EP | 745890 | A1 | 12/1996 |
| EP | 947345 | A3 | 3/2000 |

(Continued)

OTHER PUBLICATIONS

Intellectual Property Office, Search Report dated Jan. 17, 2012, GB Application No. GB1113777.5, 3 pages.

(Continued)

*Primary Examiner* — Huan Tran
(74) *Attorney, Agent, or Firm* — Fish & Richardson P.C.

(57) ABSTRACT

A printing apparatus including a tape drive for transferring a tape carrying a marking medium, and a printhead which is operable to transfer marking medium from such a tape to print an image, the tape drive including a pair of tape spool supports, upon one of which a supply spool is mountable and upon a second one of which a take up spool is mountable, each tape spool support being drivable by a respective motor, the tape drive further including a controller to control each of the motors, wherein the tape drive is operable to position a tape adjacent the printhead such that a spacing between adjacent portions of tape from which ink is removed in successive printing operations is less than 0.5 mm.

18 Claims, 3 Drawing Sheets

(56) References Cited

U.S. PATENT DOCUMENTS

| | | | | |
|---|---|---|---|---|
| 6,082,914 | A | 7/2000 | Barrus | |
| 6,305,629 | B1 | 10/2001 | Chliwnyj | |
| 6,757,129 | B2 | 6/2004 | Kuroiwa | |
| 6,975,087 | B1 | 12/2005 | Crabill | |
| 7,150,572 | B2 | 12/2006 | McNestry | |
| 7,682,094 | B2 | 3/2010 | McNestry | |
| 7,722,268 | B2 | 5/2010 | McNestry | |
| 7,748,917 | B2 | 7/2010 | McNestry | |
| 7,753,605 | B2 | 7/2010 | McNestry | |
| 8,007,190 | B2 | 8/2011 | McNestry | |
| 8,096,715 | B2 | 1/2012 | McNestry | |
| 8,221,009 | B2 | 7/2012 | McNestry | |
| 8,221,010 | B2 | 7/2012 | McNestry | |
| 8,317,421 | B2 | 11/2012 | McNestry | |
| 8,328,441 | B2 | 12/2012 | McNestry | |
| 8,591,127 | B2 | 11/2013 | McNestry | |
| 8,730,287 | B2 | 5/2014 | Bouverie | |
| 8,770,874 | B2 | 7/2014 | McNestry | |
| 2003/0049065 | A1 | 3/2003 | Barrus | |
| 2004/0146331 | A1 * | 7/2004 | McNestry et al. | 400/615.2 |
| 2008/0217454 | A1 | 9/2008 | Trago | |
| 2008/0219740 | A1 | 9/2008 | McNestry | |
| 2008/0219741 | A1 | 9/2008 | McNestry | |
| 2008/0219742 | A1 | 9/2008 | McNestry | |
| 2008/0219743 | A1 | 9/2008 | McNestry | |
| 2009/0302143 | A1 | 12/2009 | Bayang | |
| 2009/0309949 | A1 | 12/2009 | Fukutani | |
| 2010/0089962 | A1 | 4/2010 | Mehlis | |
| 2010/0172682 | A1 | 7/2010 | Hart | |
| 2013/0039685 | A1 | 2/2013 | Starkey | |
| 2013/0215210 | A1 | 8/2013 | McNestry | |

FOREIGN PATENT DOCUMENTS

| | | | |
|---|---|---|---|
| EP | 1055521 | A3 | 5/2003 |
| FR | 2783459 | A1 | 3/2000 |
| GB | 1550218 | A | 8/1979 |
| GB | 2022018 | A | 12/1979 |
| GB | 2289441 | A | 11/1995 |
| GB | 2310405 | A | 8/1997 |
| GB | 2448302 | A | 10/2008 |
| GB | 2440676 | A | 12/2008 |
| GB | 2478725 | A | 9/2011 |
| GB | 2493541 | A | 2/2013 |
| JP | 62087382 | A | 4/1987 |
| JP | 04347659 | A | 12/1992 |
| JP | 6312568 | A | 11/1994 |
| JP | 8002078 | B2 | 1/1996 |
| JP | 8067045 | A | 3/1996 |
| JP | 9001906 | A | 1/1997 |
| JP | 04339680 | B2 | 10/2009 |
| WO | WO02022371 | A3 | 8/2002 |
| WO | WO03029013 | A1 | 4/2003 |
| WO | WO2008107642 | A1 | 9/2008 |
| WO | WO2008107647 | A1 | 9/2008 |
| WO | WO2008107650 | A1 | 9/2008 |
| WO | WO2013021211 | A3 | 4/2013 |

OTHER PUBLICATIONS

Authorized Officer Athina Nickitas-Etienne, International Preliminary Report on Patentability, International Application No. PCT/GB2012/051954, issued Feb. 11, 2014, 5 pages.

Communication pursuant to Rule 114(2) EPC dated Oct. 22, 2014, European Patent Application No. 12758588.3, Observations Pursuant to Article 115 EPC.

European Patent Application No. 12758588.3, Further Examination Report dated Nov. 26, 2014.

Communication from EP Intellectual Property Office dated Jul. 11, 2013, Observations pursuant to Section 21 of the Patents Act 1977, to be published by the USPTO.

Intellectual Property Office, Third Party Observations regarding Application No. GB1302462.5, Jan. 6, 2015, 6 pages.

European Search Report, Application No. EP 13 19 2034, dated Mar. 25, 2014, 6 pages.

U.S. Appl. No. 14/179,483, Office Action Summary mailed Dec. 5, 2014, 17 pages.

U.S. Appl. No. 14/179,145, Office Action Summary mailed Apr. 3, 2015, 18 pages.

U.S. Appl. No. 13/237,802, Office Action Summary mailed Jan. 2, 2014, 19 pages.

U.S. Appl. No. 13/237,802, Response to Action of Jan. 2, 2014, filed Apr. 2, 2014, 14 pages.

U.S. Appl. No. 13/237,802, Final Office Action Summary mailed Jul. 24, 2014, 23 pages.

U.S. Appl. No. 13/237,802, Reply to Action of Jul. 24, 2014, filed Sep. 24, 2014, 9 pages.

U.S. Appl. No. 13/237,802, Reply to Action of Jul. 24, 2014, filed Dec. 19, 2014, 9 pages.

U.S. Appl. No. 13/237,802, Office Action Summary mailed Jan. 20, 2015, 17 pages.

U.S. Appl. No. 14/075,935, Office Action Summary mailed Dec. 26, 2014, 12 pages.

U.S. Appl. No. 14/075,935, Reply to Action of Dec. 26, 2014, filed Mar. 26, 2015,7 pages.

Third Party Observations submitted to UK Intellectual Property Office, Application No. GB1302542.4, dated May 15, 2015, 6 pages.

* cited by examiner

PRINTING APPARATUS AND METHOD OF OPERATING A PRINTING APPARATUS

CROSS-REFERENCE TO RELATED APPLICATIONS

This application claims the benefit of priority under 35 U.S.C. §119 of UK Patent Application No. 1302542.4, filed Feb. 13, 2013.

FIELD DESCRIPTION OF THE INVENTION

This invention relates to a printing apparatus and a method of operating a printing apparatus.

BACKGROUND OF THE INVENTION

In a so called thermal transfer printing apparatus, the printhead includes a plurality of thermal heating elements which are selectively energisable by a controller during printing to warm and soften pixels of ink from the tape and to transfer such pixels to the substrate. Such printheads typically include a very large number of thermal printing elements, for example approximately 300 thermal printing elements per inch of the array, in order to be able to print high resolution images. The printhead presses the tape against the substrate such that the pixels of ink contact the substrate before the web of the tape is peeled away, thus transferring the pixels of ink from the tape to the substrate.

Such printing apparatus includes drive apparatus for moving the tape relative to the printhead, to present fresh tape, from which pixels of ink are yet to be removed, to the printhead, such that successive printing operations can be carried out. By enabling such movement and selectively energising the printing elements in each of a plurality of positions along the substrate and tape, a desired image can be built up from printed dots.

It has long been known to provide tape drives which include two spool supports, one of which supports a supply spool on which unused tape is initially wound, and the other of which supports a take-up spool, onto which the tape is wound after it has been used. Tape extends between the spools in a tape path. Each of the spool supports, and hence each of the spools of tape, is drivable by a respective motor.

It is known to provide thermal transfer printing apparatus in two different configurations. In the first, so called "intermittent" configuration, the substrate to be printed and the tape are held stationary during a printing operation, whilst the printhead is moved across the area of the substrate to be printed. Once the printing operation is complete, the printhead is lifted away from the tape, and the tape is advanced to present a fresh region of tape to the printhead for the next printing operation.

In the second, so called "continuous" configuration, the substrate to be printed moves substantially continuously and the tape is accelerated to match the speed of the tape before the printhead is brought into thermal contact with the tape and the printing operation is carried out. In this configuration, the printhead is maintained generally stationary during each printing operation.

The tape used in thermal transfer printers is thin. Therefore it is important to ensure that the tension in the tape extending between the two spools is maintained at a suitable value or within a suitable range of tensions, in particular to enable the web to peel cleanly away from the heated ink. Too much tension in the tape is likely to lead to the tape being deformed or broken, whilst too little tension will inhibit the correct operation of the device. A slack tape is likely to affect print quality.

In the case of a printing apparatus in continuous configuration, it is also necessary to accurately control the speed of the tape, to ensure that it matches the speed of the substrate. A typical thermal transfer printer operates with substrate that advances at linear speeds between approximately 0.01 meter per second and approximately 2 meters per second. Typical substrate accelerations are up to approximately 12 meters per second per second.

In order to avoid wasting tape, whilst maintaining acceptable print quality, it is advantageous to be able accurately to control the movement of the tape, so as to position the next portion of tape to be used directly adjacent a portion of the tape from which the ink has previously been removed. It is desirable for a spacing between adjacent regions of tape from which pixels are removed to create an image, to be less than 1 mm.

It is also important to ensure that the regions of tape from which ink is removed during successive printing operations do not overlap, so that the printhead does not attempt to remove ink from a region of the tape from which the ink has already been removed. However, it is known to interlace images, such that a previously used region of tape is reused, but in the second and/or subsequent printing operations, different pixels of ink are removed from the tape to create an image. Such a method is described in the applicant's earlier patent, GB2289441, also published as U.S. Pat. No. 5,908,251.

Tape drives of various types have been proposed, for example a tape drive which includes a stepper motor for driving a take up spool so as to pull tape through along a tape path between a supply spool and the take up spool. Such a tape drive also includes a mechanical clutch for setting and maintaining the tension in the tape. Such tape drives are mechanically complex and regular maintenance of the clutch is required. Furthermore, since the supply spool is operated at a fixed torque, the tension in the tape varies as the diameter of the supply spool varies over time.

Another example of a known tape drive is one in which a take up spool and a supply spool are rotated by respective stepper motors. The stepper motors are driven in a co-ordinated manner to transfer the tape from the supply spool to the take up spool and to accurately position the tape adjacent the printhead, whilst maintaining the tension in the tape. Various methods of determining and maintaining the tension of the tape have been proposed. Such methods require the measured tension in the tape to be compared with the desired tension, and for a correction to be applied. Therefore, such methods incur a delay of at least one printing operation between the tension in the tape falling outside an acceptable range and the correction being applied.

Stepper motors have a limited update rate of the motor, owing to the inherent step size of the motor. For example, a typical stepper motor has a maximum resolution of 3200 microsteps per revolution of the motor. This limits the ability of the motor control system to accurately position the tape, which in turn sets a minimum spacing between adjacent regions of tape from which ink can be removed, which the motor control system is able to achieve. It is only possible to make a change to the operation of a stepper motor with each step. It is not possible to initiate a change whilst a stepper motor is mid-step. Therefore a motor control system which includes stepper motors includes inherent delays which are liable to cause accuracy to be limited to a certain extent.

Stepper motors are typically run in open loop control using microsteps to achieve the necessary step resolution. Angular rotor motion produced at each of the motor poles is guaranteed by the motor construction however the intervening positions produced by the microstepping cannot guarantee exact step size thus producing a positional error. This limits the ability of the tape drive to reduce the spacing between adjacent regions of tape from which ink can be removed, without risking overlapping images, which jeopardises print quality.

Known motor control systems provide accuracy which enables a user to print a series of images with a minimum spacing of 0.5 mm between adjacent portions of the tape from which ink has been removed by successive printing operations. The exact size of the spacing will be dependent upon many factors including the size of the image, the speed and acceleration of the substrate and the quality of the ribbon reel used in the printer.

A further example of a known tape drive includes a pressure roller in the tape path, which is driven by a motor. The roller directly controls the speed and position of the tape. The tape spools are driven through a mechanical clutch which maintains the tape tension between acceptable limits. Such tape drives are mechanically complex. The tape drive is typically uni-directional and this tends to cause tape wastage.

A still further example of a known tape drive is one in which two DC motors are used to drive the spools of tape (as described in FR 2783459, for example). Both of the motors operate in torque control mode and a roller which is positioned near to the printhead is used to determine the movement of the tape along the tape path. Such a tape drive includes rollers on the inked side of the tape which can require regular maintenance. Furthermore, desired printing speeds and tape accelerations are increasing leading to difficulties in operating such a drive.

SUMMARY OF THE INVENTION

The invention is particularly useful in relation to a printing apparatus which utilises a printing tape or "ribbon" which includes a web carrying marking medium, e.g. ink, and a printhead which, in use, removes marking medium from selected areas of the web to transfer the marking medium to a substrate to form an image, such as a picture or text. More particularly, but not exclusively, the invention relates to a so called thermal transfer printing apparatus.

In accordance with the present invention, there is provided a printing apparatus including a tape drive for transferring a tape carrying a marking medium, and a printhead which is operable to transfer marking medium from such a tape to print an image, the tape drive including a pair of tape spool supports, upon one of which a supply spool is mountable and upon a second one of which a take up spool is mountable, each tape spool support being drivable by a respective motor, the tape drive further including a controller to control each of the motors, wherein the tape drive is operable to position a tape adjacent the printhead such that a spacing between adjacent portions of tape from which ink is removed in successive printing operations is less than 0.5 mm.

The spacing between adjacent portions of tape from which ink is removed in successive printing operations may be approximately 0.25 mm.

The printing apparatus may be a thermal transfer printer.

The motors and the controller may be part of a motor control system which also includes a rotary position encoder associated with at least one of the motors, and wherein the motor having the associated rotary position encoder is switchable between a first control mode wherein position is a dominant control parameter to a second control mode where torque is the dominant control parameter.

Both motors may have an associated rotary position encoder, and both motors may be switchable between a first control mode wherein position is a dominant control parameter to a second control mode where torque is the dominant control parameter.

The or each motor may be a brushless DC motor or other functionally comparable motor.

A measurement of the velocity of the or each motor may be fed back to the controller and is used to determine an output of the controller which is received by the motor to control the movement of the motor.

When the or each motor is in the first control mode, the controller may receive an input relating to a demanded position of the motor and an actual position of the motor, and determine a required change in position which is to be carried out by the motor.

The controller may use the required change in position, the velocity of the motor and a torque bias value, to determine the output of the controller which controls the movement of the motor.

When the or each motor is in the second control mode, the controller may receive an input relating to a torque bias value which is used to determine an output of the controller which controls movement of the motor.

The controller may receives an input relating to the velocity of the motor which is used in conjunction with the torque bias value to determine the output of the controller which controls movement of the motor.

Switching between the first control mode and the second control mode may be a smooth transition.

Both motors may be drivable in the first control mode during movement of tape between the tape spool supports, and one of the motors may be switchable from the first control mode to the second control mode when the movement of the tape has been completed, and from the second control mode to the first control mode when tape movement is to be carried out.

According to a second aspect of the invention, there is provided a method of operating a printing apparatus according to the first aspect of the invention including positioning a tape adjacent the printhead to enable marking medium to be removed from a first portion of the tape during a first printing operation, and positioning the tape adjacent the printhead to enable marking medium to be removed from a second portion of the tape during a subsequent printing operation, such that a spacing between the first portion of tape and the second portion of tape is less than 0.5 mm.

The spacing between the first portion of tape and the second portion of tape may be 0.25 mm.

DESCRIPTION OF THE DRAWINGS

The invention will now be described, by way of example only, with reference to the accompanying drawings, of which.

DETAILED DESCRIPTION OF THE INVENTION

Figure 1:
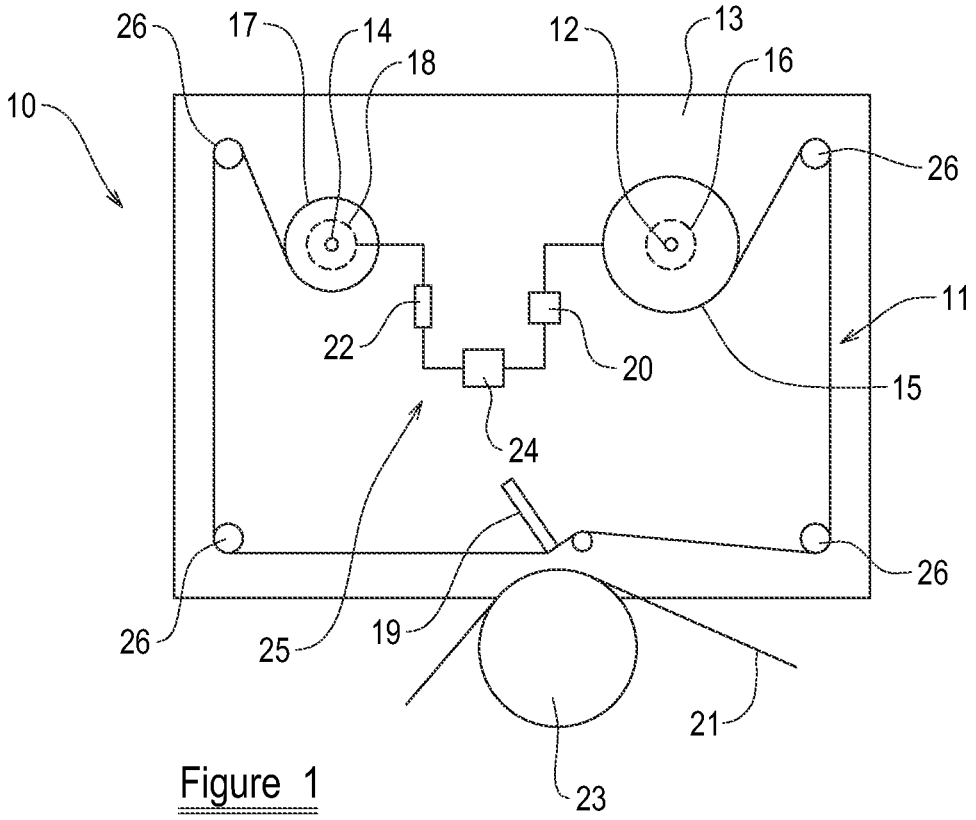
FIG. 1 is an illustrative view of part of a thermal printing apparatus including a motor control system according to the present invention.
Figure 2:
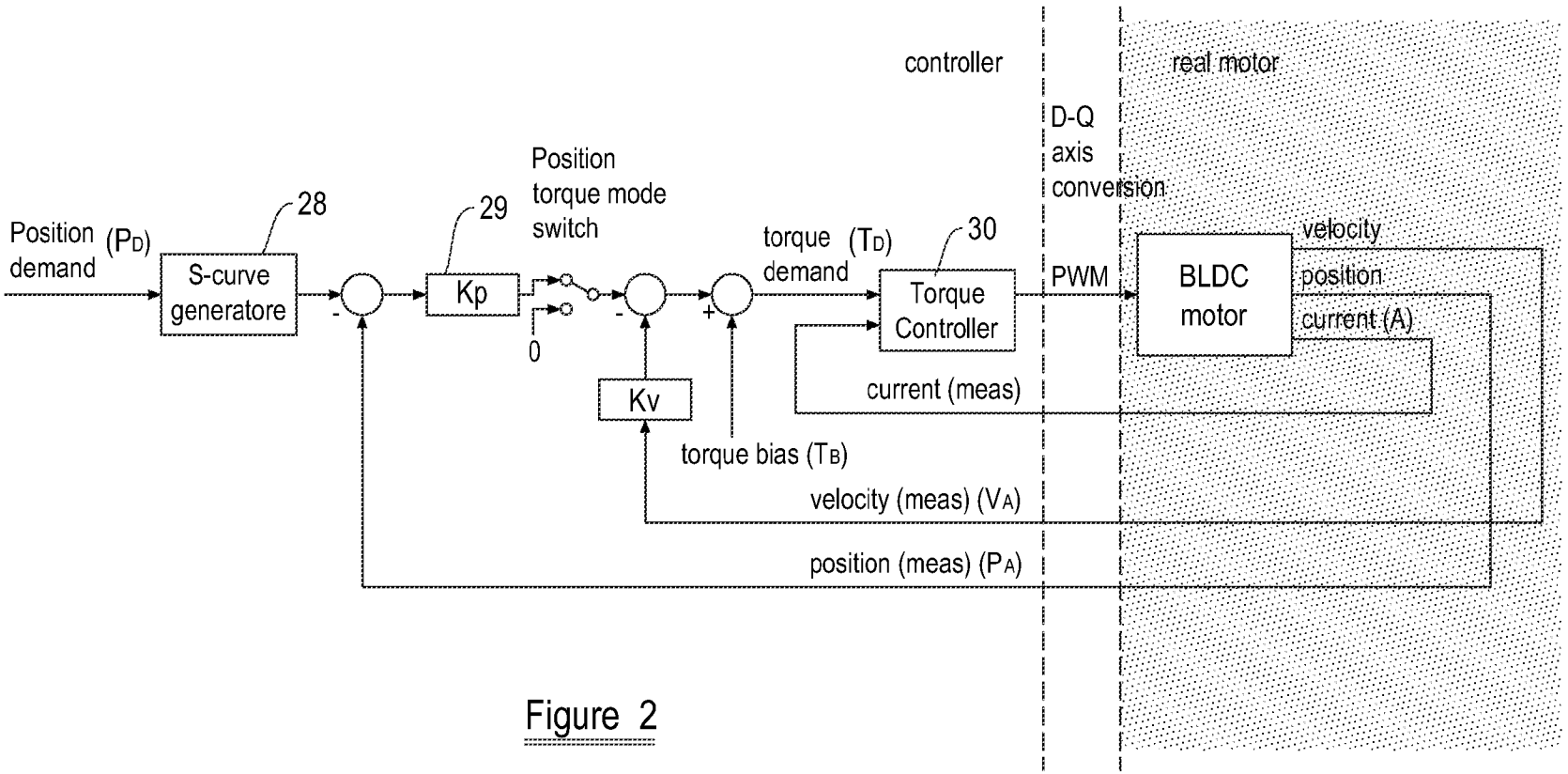
FIG. 2 is an illustrative view of a feedback circuit of the motor control system.

Referring to FIG. 1, there is shown a part of a printing apparatus 10. The printing apparatus 10 includes a tape drive shown generally at 11. The printing apparatus includes a housing 13, in or on which is mounted a first spool support 12 and a second spool support 14, which form part of the tape drive 11. A spool of tape 15, 17, for example inked printer ribbon, is mountable on each of the supports 12, 14. The spool supports 12, 14 are spaced laterally from one another. The printing apparatus 10 also includes a printhead 19 for transferring ink from the tape to a substrate 21 which is entrained around a roller 23 adjacent the printhead 19. Depending upon the configuration of the printer, the substrate 21 may be positioned adjacent the printhead 19 on a platen, rather than a roller.

Each of the spool supports 12, 14 is independently drivable by a respective motor 16, 18. Each of the motors 16, 18 is a brushless DC motor. Each of the spool supports 12, 14 is rotatable clockwise and anti-clockwise by means of its respective motor 16, 18. Each motor 16, 18 is electrically connected to a controller 24 via a sensor 20, 22. This sensor is typically a rotary encoder although it will be appreciated that other technologies are perfectly acceptable. The controller 24 is operable to control the mode of operation of each of the motors 16, 18 and the amount of drive provided by each of the motors 16, 18. Each sensor 20, 22 enables the controller 24 to determine the angular position and rotational speed of a rotor of the respective motor 16, 18. Information relating to the current drawn by each motor 16, 18 is provided to the controller 24. The motors 16, 18, the sensors 20, 22 and the controller 24 all form part of a motor control system 25.

The controller 24 receives inputs relating to a demanded position of each motor 16, 18 to advance the tape to a required position, the actual position of the motor 16, 18, the measured velocity of each motor 16, 18, the current drawn by the motor 16, 18, and a torque bias $T_B$ required by the motor at a given point in time.

The purpose of the torque bias will be explained in more detail below. The position of the controller 24 relative to the remainder of the printing apparatus 10 is irrelevant for the purposes of the present invention.

In use, a supply spool 17, upon which unused tape is wound, is mounted on the spool support 14, and a take up spool 15, upon which used tape is wound, is mounted on the spool support 12. The tape generally advances in a tape path between the supply spool 17 towards the take up spool 15. The tape is guided in the tape path between the spools 15, 17 adjacent the printhead 19 by guide members 26.

The tape drive 11 requires calibration before printing operations can commence. Such calibration is generally required when the printing apparatus 10 is switched on, and when the spools of tape 15, 17 are replaced. The calibration process includes determining an initial estimate of the diameters of each of the spools of tape 15, 17 mounted on the spool supports 12, 14. An example of a suitable method of obtaining such an estimate is described in detail in the applicant's patent GB2310405, also published as U.S. Pat. No. 5,921,689. As tape passes from one spool to the other, for example from the supply spool 15 to the take up spool 17, it passes over a roller of known diameter. The roller is preferably one of the guide members 26. Tape is drawn from the supply spool 17, with the motor 16 which drives the take-up spool support 12 operating in position control mode. The motor 18 which drives the supply spool support 14 operates in torque control mode to deliver a predetermined torque.

Following the calibration process, the motor control system 25 maintains and updates values for the diameters of the spools 15, 17 by monitoring the amount of tape transferred from the supply spool to the take-up spool. The controller 25 takes into account the thickness of the tape to compute an expected change in the diameters of the spools 15, 17 over a period of time. This technique relies on the tension in the tape being kept substantially constant during printing operations and advancement of the tape between the spools 15, 17.

When the tape is at rest, the motor control system 25 maintains the desired tape tension by operating one motor, for example the supply spool motor 18, in a first control mode, in which position is a dominant control parameter. This first control mode will be referred to herein as "position control mode". The other motor, for example the take up spool motor 16, is operated in a second control mode, in which the dominant control parameter is torque. The second control mode will be referred to herein as "torque control mode".

One motor 18 ensures that the absolute position of the tape relative to the printhead 19 is accurately controlled, whilst the other motor 16 maintains the tension in the tape at the desired predetermined value.

A demanded position $P_D$ of the motor 18 is received by an S-curve generator 28, an output of which is used, along with an actual position $P_A$ of the motor 18 in an algorithm, preferably a PID algorithm, applied by an electronic filter 29 to determine the change in position required to be carried out by the motor 18. An actual velocity $V_A$ of the motor is input to a second electronic filter 31, which performs an algorithm, again preferably a PID algorithm, and an output of the second electronic filter 31 is used in conjunction with an output of the first electronic filter 29, relating to the change in position of the motor 18, to determine a demanded torque $T_D$ to be provided by the motor 18. A demanded torque $T_D$ and the amount of current A drawn by the motor 18 are fed back to a torque controller 30 to provide a control output to the motor 18. Although the algorithms implemented by the filters 29, 31 are described as being PID algorithms, it will be appreciated that any Linear Time Invariant filter function may be used.

The motor 16 being operated in torque control mode does not use inputs relating to demanded position $P_D$ or actual position $P_A$ of the motor 16. The inputs relating to actual velocity $V_A$ may also be disregarded. The torque controller 30 receives a torque demand $T_D$ based only on the torque bias $T_B$, and optionally upon the actual velocity $V_A$ of the motor 16. The current A of the motor 16 may also be fed back to the torque controller 30 to generate a control output for the motor 16. The intention of the torque bias $T_B$ is to apply a torque offset to the motor 18, which is in position control mode, to completely counteract the constant torque provided by the other motor 16, which is in torque control mode. This then means that the motor 18 in position control mode is only required to produce an instantaneous torque which will hold that motor 18 in position and does not need to compensate for the torque applied by the other motor 16. So if, for example, the motor 16 in torque control mode is applying 3N to the ribbon, the motor 18 in position control mode will have a torque bias applied to generate the equivalent of 3N to balance the tension in the tape.

When the tape is required to be advanced between the spools 15, 17, the controller 25 causes both of the motors 16, 18 to operate in position control mode. The transition of the motor 16 which was previously operated in torque control mode into position control mode is smooth. This transition from torque control mode to position control mode is carried out by gradually reducing the torque bias $T_B$ to a nominal value, which may be zero.

During tape advance, the two motors 16, 18 advance the tape accurately along the tape path past the printhead 19, using the values of the diameters of the spools 15, 17 and a co-ordinated moving target position. The co-ordinated moving target position is arrived at by the control system 25 determining the desired position of the tape at a point in time, and the controller 24 controls the motors 16, 18 to achieve this desired position of the tape.

During tape advance, it is desirable for the amount of tape fed into the tape path from the supply spool 17 to be equal to the amount of tape taken up by the take up spool 15, in order to maintain the tape tension substantially constant. However, this is difficult to achieve in known tape drives because disturbances of the tape which occur during printing operations, and the fact that the spools 15, 17 are not perfectly cylindrical mean that the control of the motors 16, 18 is based upon inaccurate estimates, and thus the tension is unlikely to be kept as near to constant as desired. In the present invention, the smooth transition of the take up motor from position control mode to torque control mode prevents the accumulation of such errors increasing long term drift in the ribbon tension.

Once the advancement of the tape has been completed, one of the spool motors 16, 18, for example the take up spool motor 16, smoothly transitions from position control mode to torque control mode, by increasing the torque bias $T_B$ relating to the motor 16, whilst the other spool motor, for example the supply spool motor 18, remains in position control mode. Gradually increasing the torque bias $T_B$ from zero during deceleration of the tape causes a smooth transition of the motor from position control mode to torque control mode, before the inputs relating to position $P_A$, $P_D$ are disregarded. The other motor, in this case the supply spool motor 18, remains in position control mode, however the value of torque bias $T_B$ applied to this motor may be adjusted, so as to compensate for the increase in torque which is likely to be caused as a result of switching the take up spool motor 16 into torque control mode. In practice, it may be possible to retain a constant torque bias $T_B$ irrespective of whether the motors 16, 18 are stationary or in motion, however, the desired torque bias $T_B$ will be such that it causes the tension in the tape to remain substantially constant, by the two motors 16, 18 applying equal and opposite forces on the tape.

The motor control system 25 is capable of testing the accuracy of its control of the advancement of the tape in two ways.

The first method of testing is to determine the ratio of the torques applied to the two motors 16, 18 when the tape drive 11 is stationary. In such a situation, one motor 16, 18 is stationary, whilst the other motor 16, 18 supplies a torque so as to maintain its position, and to maintain the tension in the tape. The ratio of the torques should be the same as the ratio of the diameters of the spools 15, 17 at that time.

The second method of testing is carried out as the tape drive 11 is completing a movement of the tape. As the take up spool motor 16 transitions from position control mode to torque control mode, the controller 24 monitors the angular position change of take up spool motor 16 between its expected target position and its rest position at the correct ribbon tension, using the sensor 20. The angular position change that occurs together with the spool diameter gives a measure of the disturbances and errors in the position control of the motor 16.

The operation of the control system 25 is iterative, in that it takes into account the results of the testing method(s) carried out over a number of tape advancements (printing cycles) to correct the estimate of the diameters of the spools 15, 17 for future printing cycles.

The method of operation of the tape drive 11 described above retains the supply spool motor 18 in position control, as the supply spool 17 is more likely to be cylindrical than the take up spool, the tape on the supply spool 17 not having been unwound, and ink removed from it before being rewound on a different spool. Therefore this mode of operation is more likely to provide accurate positioning of the tape adjacent the printhead 19. However, it will be appreciated that either spool motor 16, 18 could be switched to torque control mode during tape advance.

When power is removed from the motors 16, 18, the control system 25 manages the tension of the tape in the tape path. If the tape is in tension when power is removed from the motors 16, 18, one or both of the spools 15, 17 will be accelerated by the force exerted by the tension in the tape. Even when the tape is no longer in tension, the or each spool 15, 17 which has been accelerated will continue to rotate owing to the momentum of the spool(s) 15, 17, and tape may spill from the printing apparatus 10. Of course, this is undesirable, and unacceptable. To overcome this problem, the control system 25 operates at least one of the motors 16, 18, so as to enable a controlled release of tension from the tape, before power is removed from the motors 16, 18. Alternatively, a mechanical device may be used to inhibit or prevent the acceleration of the spools 15, 17 upon removal of power from the motors 16, 18.

Figure 3:
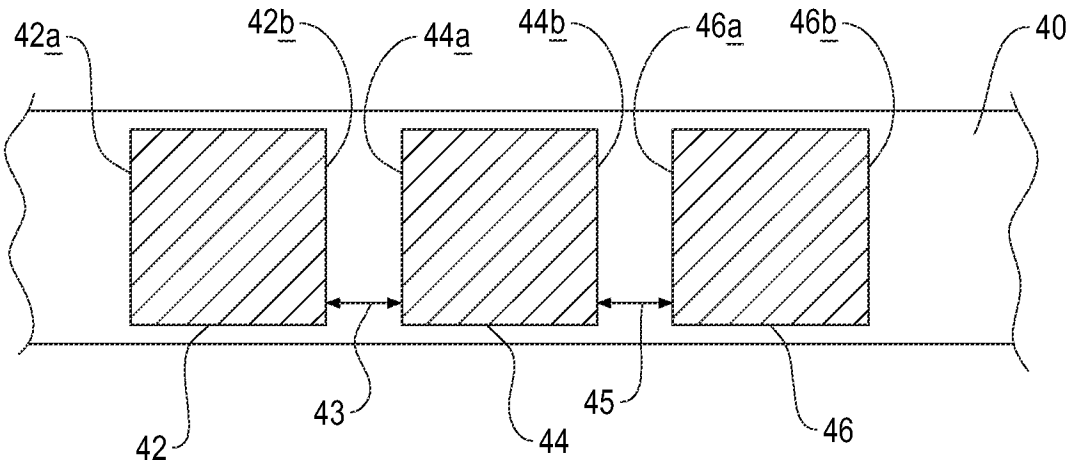
FIG. 3 is an illustrative view of a tape, showing a plurality of portions of the tape from which ink has been removed.

FIG. 3 shows a portion of a tape 40 which is suitable for use in a printing apparatus. Where the tape drive 11 is to be used in a thermal transfer printing apparatus, the tape 40 to be transferred is an inked tape, which is substantially uniformly covered with a marking material, e.g. ink, and the printhead 19 is a thermal print head.

It is advantageous to use as much of the ink on the tape as possible, to avoid wasting tape. The greater the number of images which can be printed from a typical tape, and therefore, the greater the number of printing operations which can be carried out before the tape needs to be replaced, the more economical the printing apparatus.

During a first printing operation, a first portion 42 of the tape 40 is positioned adjacent the printhead 19, and ink on the first portion 42 of the tape 40 is transferred from the tape 40 to an adjacent substrate 21. The ink is removed from the first portion 42 during the first printing operation, in a pattern so as to produce a desired image on the substrate 21. The image may include text and/or any other pattern, for example a barcode. The first portion 42 of the tape 40 has a leading edge 42*a* and a trailing edge 42*b*, each of which defines an extent of the image being printed.

In a subsequent printing operation, a second portion 44 of the tape 40 is positioned adjacent the printhead 19, such that pixels of ink can be removed from the second portion 44 to print a second image. The second portion 44 is similar to the first portion 42 and has a leading edge 44*a* and a trailing edge 44*b*.

The movement of the tape 40 relative to the printhead 19 is accurately controlled by the motor control system 25, using the method described above, such that a spacing 43 between the adjacent portions of tape 42, 44 from which ink is removed in successive printing operations is less than 0.5 mm. Preferably, the spacing 43 is 0.25 mm. The spacing is the distance between the trailing edge 42*b* of the first portion and the leading edge 44*a* of the second portion 44 of the tape 40.

In a third printing operation, a third portion 46 of tape 40 is positioned adjacent the printhead 19, such that pixels of ink may be removed from the third portion 46, to print a third image on to the substrate 21. The third portion has a leading edge 46*a* and a trailing edge 46*b*. A spacing 45, between the trailing edge 44*b* of the second portion of tape 40 and the leading edge 46*a* of the third portion 46 of the tape 40, is also less than 0.5 mm, and is preferably 0.25 mm.

Any number of printing operations may be carried out in succession, and it will be understood that pixels of ink from adjacent portions 42, 44, 46 of the tape 40 need not be removed in consecutive printing operations. Thus, the term "successive", when used herein, is intended to include, but not be limited to consecutive printing operations. In other words, the order in which ink is removed from the portions 42, 44, 46 of tape is not important. For example, ink may be removed from the first portion 42, then the third portion 46, and then the tape may be positioned such that ink is removed from the second, intermediate portion 44.

Each edge 42*a*, 42*b*, 44*a*, 44*b*, 46*a*, 46*b* of each portion of tape 42, 44, 46 is an imaginary line which extends along the width of the tape, and its position is determined by the extent of the image which is to be printed from the portion 42, 44, 46 of the tape 40. Each edge 42*a*, 42*b*, 44*a*, 44*b*, 46*a*, 46*b* is shown as a generally straight line, but it will be appreciated that an image which is printed from each portion of tape need not have straight edges, and a part only of the image to be printed may extend to either or both edges 42*a*, 42*b*, 44*a*, 44*b*, 46*a*, 46*b* of the portion 42, 44, 46 from which the image is being printed. The size of each portion 42, 44, 46 is determined by the maximum extent of the each image to be printed.

The accuracy of motor control system 25 and the tape drive 11 is such that it is always possible for the spacing between adjacent portions of tape from which ink is removed in successive printing operations to be less than 0.5 mm. For the avoidance of doubt, the spacings 43, 45 referred to are distances measured along the tape 40 and are not spacings between images printed on a substrate, or spacings between adjacent substrates.

Reducing the spacing between adjacent portions of tape from which ink can be removed during successive printing operations increases the number of images which can be printed from an identical tape. It is envisaged that a minimum spacing of 0.25 mm can be achieved in this embodiment where, in similar conditions, known systems achieve a minimum spacing of 0.5 mm.

The invention described above enables improved performance when compared with known motor control systems, particularly those which include stepper motors for driving the spool supports. Known motor control systems do not permit the spacing between adjacent images to be so small, and therefore the present invention provides less waste and improved economy for users.

For example, in a known system, if a user prints a series of 10 mm images from a typical tape having a length of 1100 m, with a spacing of 0.5 mm between adjacent portions of tape from which ink is removed, it is possible for approximately 104,750 images to be printed. With the present invention, printing a series of 10 mm images with a 0.25 mm spacing between the portions of tape from which ink is removed enables approximately 107,300 images to be printed from a 1100 m tape. This is an increase of approximately 2550 images per typical tape.

The closed loop control employed in the tape drive 11 allows the tape motion to be constantly adjusted throughout the print cycle so that the actual tape position matches the demands of the control system more accurately. This means the tape position at the start of the print is more accurately controlled and consistent print gaps are delivered, even when the velocity of the substrate on to which the images are to be printed is continually changing. For example, in a typical thermal transfer printer, which includes stepper motors for driving the spool supports, printing at 500 mm/s with a 100 mm diameter reel of tape, the motor will be rotating at 1.6 revolutions per second. If the stepper motor drive system is driven by a standard microstepping drive which delivers 1600 steps per motor revolution, the steps will occur at 390 μs intervals. The tape drive described in this invention typically employs a control system which completes a control "loop" every 50 μs, regardless of the diameter of the reel. Therefore the motor position and speed is assessed and can be adjusted far more frequently than in a comparable stepper motor printer.

Whilst the invention has been described in relation to thermal printing apparatus, it will be appreciated that the motor control system may be utilised in relation to other devices or apparatus.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

The invention claimed is:

1. A printing apparatus including a tape drive for transferring a tape carrying a marking medium, and a printhead which is operable to transfer marking medium from such a tape to print an image, the tape drive including a pair of tape spool supports, upon one of which a supply spool is mountable and upon a second one of which a take up spool is mountable, each tape spool support being drivable by a respective motor, the tape drive further including a controller to control each of the motors, wherein the tape drive is operable to position a tape adjacent the printhead such that a spacing between adjacent portions of tape from which ink is removed in successive printing operations is less than 0.5 mm, wherein the motors and the controller are part of a motor control system which also includes a rotary position encoder associated with at least one of the motors, and the motor control system is configured to test an accuracy of its control of advancement of the tape in two ways.

2. A printing apparatus according to claim 1 wherein the spacing between adjacent portions of tape from which ink is removed in successive printing operations is approximately 0.25 mm.

3. A printing apparatus according to claim 1 wherein the printing apparatus is a thermal transfer printer.

4. A printing apparatus according to claim 1, wherein the motor having the associated rotary position encoder is switchable between a first control mode wherein position is a dominant control parameter to a second control mode where torque is the dominant control parameter.

5. A printing apparatus according to claim 4 wherein both motors have an associated rotary position encoder, and both motors are switchable between a first control mode wherein position is a dominant control parameter to a second control mode where torque is the dominant control parameter.

6. A printing apparatus according to claim 4 wherein the or each motor is a brushless DC motor or other functionally comparable motor.

7. A printing apparatus according to claim 4, wherein a measurement of the velocity of the or each motor is fed back to the controller and is used to determine an output of the controller which is received by the motor to control the movement of the motor.

8. A printing apparatus according to claim 7 wherein when the or each motor is in the first control mode, the controller receives an input relating to a demanded position of the motor and an actual position of the motor, and determines a required change in position which is to be carried out by the motor.

9. A printing apparatus according to claim 8, wherein the controller uses the required change in position, the velocity of the motor and a torque bias value, to determine the output of the controller which controls the movement of the motor.

10. A printing apparatus according to claim 4 wherein when the or each motor is in the second control mode, the controller receives an input relating to a torque bias value which is used to determine an output of the controller which controls movement of the motor.

11. A printing apparatus according to claim 10 wherein the controller receives an input relating to the velocity of the motor which is used in conjunction with the torque bias value to determine the output of the controller which controls movement of the motor.

12. A printing apparatus according to claim 5 wherein both motors are drivable in the first control mode during movement of tape between the tape spool supports, and wherein one of the motors is switchable from the first control mode to the second control mode when the movement of the tape has been completed, and from the second control mode to the first control mode when tape movement is to be carried out.

13. A method of operating a printing apparatus according to claim 1 including positioning a tape adjacent the printhead to enable marking medium to be removed from a first portion of the tape during a first printing operation, and positioning the tape adjacent the printhead to enable marking medium to be removed from a second portion of the tape during a subsequent printing operation, such that a spacing between the first portion of tape and the second portion of tape is less than 0.5 mm.

14. A method of operating a printing apparatus according to claim 13, wherein the spacing between the first portion of tape and the second portion of tape is 0.25 mm.

15. A printing apparatus according to claim 1, wherein the motor control system is configured to test the accuracy of its control of the advancement of the tape by determining a ratio of torques applied to the motors, respectively, when the tape is stationary, and comparing the ratio of the torques to a ratio of diameters of the supply spool and the take up spool.

16. A printing apparatus according to claim 1, wherein the motor control system is configured to test the accuracy of its control of the advancement of the tape by monitoring an angular position change of the motor that drives the take up spool during a transition from a position control mode to a torque control mode as a movement of the tape is completed, the angular position change being between an expected target position and a rest position at a correct tension for the tape.

17. A printing apparatus according to claim 1, wherein a first of the two ways comprises the motor control system being configured to determine a ratio of torques applied to the motors, respectively, when the tape is stationary, and compare the ratio of the torques to a ratio of diameters of the supply spool and the take up spool, and a second of the two ways comprises the motor control system being configured to monitor an angular position change of the motor that drives the take up spool during a transition from a position control mode to a torque control mode as a movement of the tape is completed, the angular position change being between an expected target position and a rest position at a correct tension for the tape.

18. A printing apparatus according to claim 17, wherein the motor control system is configured to perform each of the two ways of testing iteratively to take into account results of the testing carried out over a number of tape advancements to correct estimates of the diameters of the supply spool and the take up spool for future printing cycles.

* * * * *